US005242357A

United States Patent [19]

Kerr

[11] Patent Number: 5,242,357

[45] Date of Patent: Sep. 7, 1993

[54] DECELERATION METHOD AND APPARATUS FOR A MOVING BOLSTER FOR A PRESS

[75] Inventor: Peter Kerr, Columbus, Ohio

[73] Assignee: L. Schuler GmbH, Goeppingen, Fed. Rep. of Germany

[21] Appl. No.: 774,615

[22] Filed: Oct. 10, 1991

Related U.S. Application Data

[63] Continuation-in-part of Ser. No. 545,701, Jun. 29, 1990, Pat. No. 5,121,538.

[51] Int. Cl.[5] ..... B21J 13/08; B23Q 3/155

[52] U.S. Cl. ..... 483/1; 72/446; 83/563; 483/1; 483/28

[58] Field of Search ..... 83/563; 72/446, 448; 91/433, 454; 100/918; 483/28, 29, 1, 7

[56] References Cited

U.S. PATENT DOCUMENTS 4,433,620 2/1984 Kiyosawa ..... 72/446 X
4,630,536 12/1986 Shah ..... 72/448 X
5,121,538 6/1992 Kerr ..... 483/7

*Primary Examiner*—Z. R. Bilinsky
*Attorney, Agent, or Firm*—Vorys, Sater, Seymour & Pease

[57] ABSTRACT

A method and apparatus for changing dies on a moving bolster for a press including a control circuit in combination with a cam-actuated deceleration valve. A cam is located at a predetermined location along a path for the moving bolster. Upon reaching the cam location when the bolster is moving toward or away from the press, the deceleration valve is actuated to inhibit and shut off a flow of air to air-operated motors on the bolster. Thereupon, the bolster moves to a stop at a predetermined location relative to the press.

4 Claims, 4 Drawing Sheets

DECELERATION METHOD AND APPARATUS FOR A MOVING BOLSTER FOR A PRESS

This application is a continuation-in-part of Ser. No. 07/545,701 filed Jun. 29, 1990, now U.S. Pat. No. 5,121,538.

BACKGROUND OF THE INVENTION

This invention relates to a method and apparatus for changing dies on a moving bolster for a press, particularly a large press. More particularly, this invention relates to a pneumatic control circuit adapted to decelerate the moving bolster to a smooth stop within or away from the press. Still more particularly, this invention relates to a slowdown valve for use in a circuit of the type described for controlling the movement of a moving bolster during die changing.

Large presses are well known for making large items such as automobile body parts by pressing a metal blank. Typically, such presses include a pressing apparatus for forming a part from a metallic blank which is inserted between the pressing apparatus and a die positioned in a bolster.

A typical arrangement utilizes a moving bolster, which is withdrawn from the press when a change of the die in the bolster is required. For example, the die for an automobile side panel may be removed from the bolster and another die, such as a hood die, is secured to the bolster in its place. Thereafter, the bolster with the hood die attached is moved into position and secured within the press. This procedure, and indeed the art of presses in general is well-developed.

However, the expeditious changing of dies remains a problem in this art. In addition to minimizing production interruption for a die change in normal circumstances, it is desired to minimize inventory of a particular part for cost reasons. Thus, while large numbers of a particular part might be pressed before changing to another part because of the long time needed to change the dies, now it is a significant desire in the art to produce fewer parts before a die change. This requires therefore that die changes be expedited and completed in a short time.

Such presses are massive with capacities up to thousands of tons of pressure to be exerted on dies which can weigh in the order of 40 or 50 tons. Accordingly, the bolsters and the dies are able to withstand such pressures in the pressing operation, largely through their size and structure. It is a problem, however, when undergoing expedited die changing of the type described, to move such massive parts in a way which satisfactorily controls movement and momentum of the combination, both in withdrawing the die/bolster combination from the press, but particularly in inserting the new die/bolster combination into the press. It is of course desirable to move the die and bolster as promptly as possible, but a risk of damage to the equipment for failure to stop adequately must be avoided given the masses involved.

Accordingly, it is a problem in this art to provide a control circuit, such as pneumatic control circuit compatible with typical control circuits for moving such equipment, which can control acceleration, deceleration, and stopping of such equipment.

It is another problem in this art to automate such stopping particularly within the press, since operator judgment if faulty can cause significant damage for failure of the equipment to stop precisely within the press. Thus, it is desired to provide a circuit which is responsive to a positive cam on the track of travel to initiate deceleration and stoppage.

It is another problem in this art to provide a control valve responsive to the cam for use in the pneumatic circuit of the invention to control deceleration and stoppage of the die and bolster at a predetermined time, with a desired hold and subsequent release of the pneumatic braking.

These and other objects of the invention will be apparent from a detailed description of the invention which follows.

BRIEF SUMMARY OF THE INVENTION

Directed to achieving the foregoing objectives, one aspect of the invention relates to a pneumatic circuit for controlling deceleration of a moving bolster to achieve a controlled stop for a die and bolster combination. The circuit includes an air supply in circuit with a pilot operating 4-way 2-position valve for providing air to a pair of quick exhaust, directional valves for providing air to a deceleration valve according to the invention. The deceleration valve permits forward movement of the air motor through a control valve until its cam-operated member is actuated by contact with a positive cam on the track for the bolster at a predetermined location near or within the press. The location is determined so that the deceleration valve and circuit can operate to provide a controlled stop to the equipment. When the cam-actuated member is operated, the forward air supply is interrupted, while permitting the bolster to move to a stop, either by its own momentum or by the use of a reverse air supply initiated to provide reverse air for the motor under the control of a cam operated valve or both. In any case, the cam also sets the circuit to a reverse mode, so that the bolster and die can be withdrawn on its next cycle. Thereupon, the die/bolster combination decelerates to a controlled stop within the press.

A significant advantage of the invention is that it permits significant increases in the speed of movement of the bolsters since the deceleration and stoppage of the bolster is controlled. Speeds of up to 50 feet per minute are possible as compared to an average speed for the bolsters before modification of about 10 to 15 feet/-min.

The deceleration valve according to the invention is mounted to the bolster and is activated by either of two cams, one mounted on the press bed and another mounted away from the press bed. The main air lines running to the motor are then rerouted through the deceleration valve which in turn reduces the volume of air to the motor when activated by the cam causing the motor to slow down. It is a feature of the valve according to the invention to provide a controlled clearance, such as 0.010 in. clearance between the spool and the valve body, thus allowing an internal by-pass of air to the motor after the valve is closed by the cam. The by-pass air is used to bleed down air trapped in the circuit after controlled stop. The deceleration valve also causes the bolster to idle onto its stop at about 2 ft/min by its structure in combination with the control circuit.

It is another feature of the invention that, when the bolster is on its stop, the main air supply is shut off. A column of air is trapped between the motor and the deceleration valve which allows the bolster to maintain a load on the stop while the bolster is lowered onto the press bed. The column of air is bled off to atmosphere through a small air jet with a short blow-down time of about 20 seconds.

These and other features of the invention will become apparent from a detailed description of the invention which follows taken in conjunction with the accompanying drawings.

DETAILED DESCRIPTION OF THE PREFERRED EMBODIMENT

Figure 1:
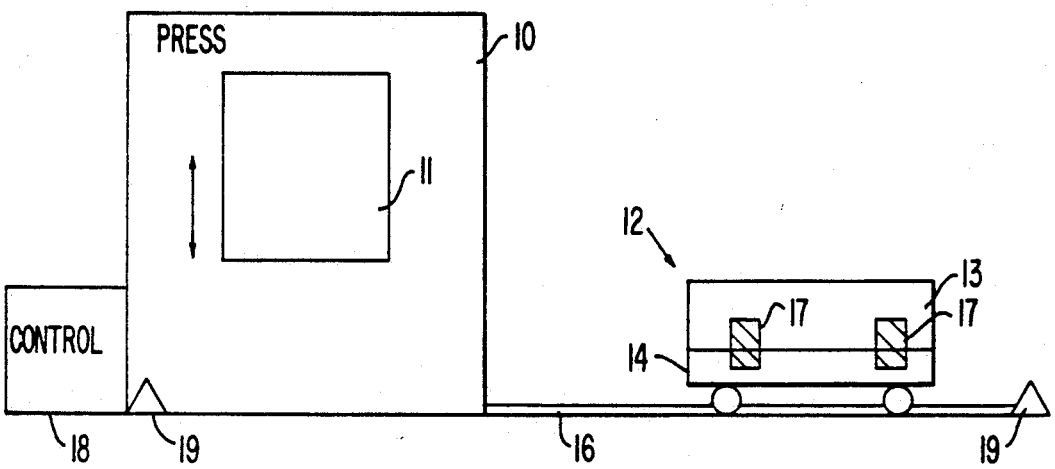
FIG. 1 (PRIOR ART)
FIG. 1 is a schematic view of the major components of a conventionally controlled moving bolster arrangement for a press.
Figure 2:
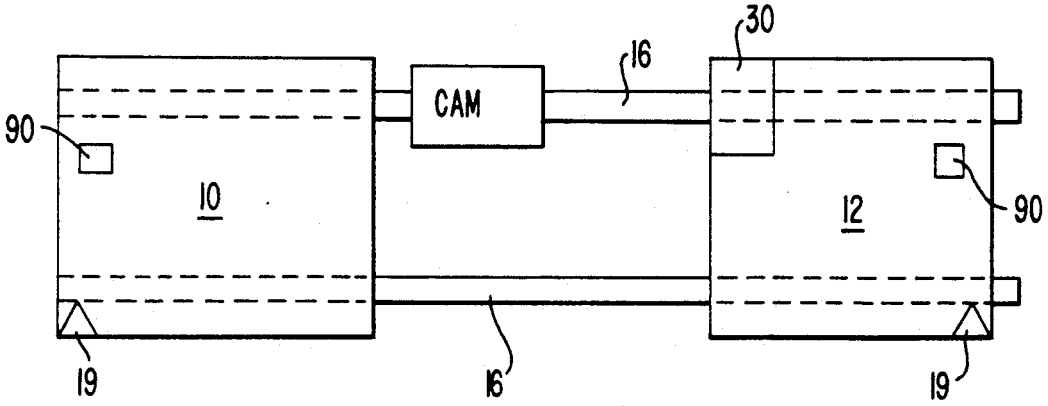
FIG. 2 is a top view of a portion of FIG. 1 showing the moving bolster, with a cam located at a predetermined position along the bolster path

In FIGS. 1 and 2, a schematic view is shown of a press, designated by the reference numeral 10. The press 10 is conventionally equipped with a moving bolster shown generally at the reference numeral 12 on which a die 13 is affixed. Such moving bolster arrangements are well known for assisting die changes in the press 10. Conventionally, a combination of a first die 13 on a moving bolster 12 is in production in the press 10 while a second set of a die and a moving bolster rests outside the press 10 and is prepared for the next production run. Thus, in this way, production runs for particular parts made from a particular die can be shortened if the down time from the die change is rapid and economical. Prior to the development of such moving bolster arrangements, die changes were costly so extended production runs were usually the norm rather than the exception. With the advent of moving bolsters of the type generally depicted in FIGS. 1 and 2, production runs could be more limited.

In such arrangements, a die 13 is affixed to the bolster 12 via T-bolts (not shown). The bolster 12 includes sufficient pneumatic circuitry or components to permit the equipment to traverse laterally from the at-rest position to a production position within the press 10 for receiving the stamping anvil 11 of the press 10 in a mating relationship. Usually, such circuits are pneumatic, so the invention is here discussed as a pneumatic circuit in its preferred embodiment.

The apparatus of FIGS. 1 and 2 is conventionally controlled by a manual control. The steps in a die change, which are controlled manually, include unclamping of the dies on the slide, raising and moving out the exchanged moving bolster and dies, moving in, lowering, centering and reclamping. Against this background of conventional equipment, the invention of this application relates to a deceleration valve and pneumatic circuit for application to this system.

Figure 3:
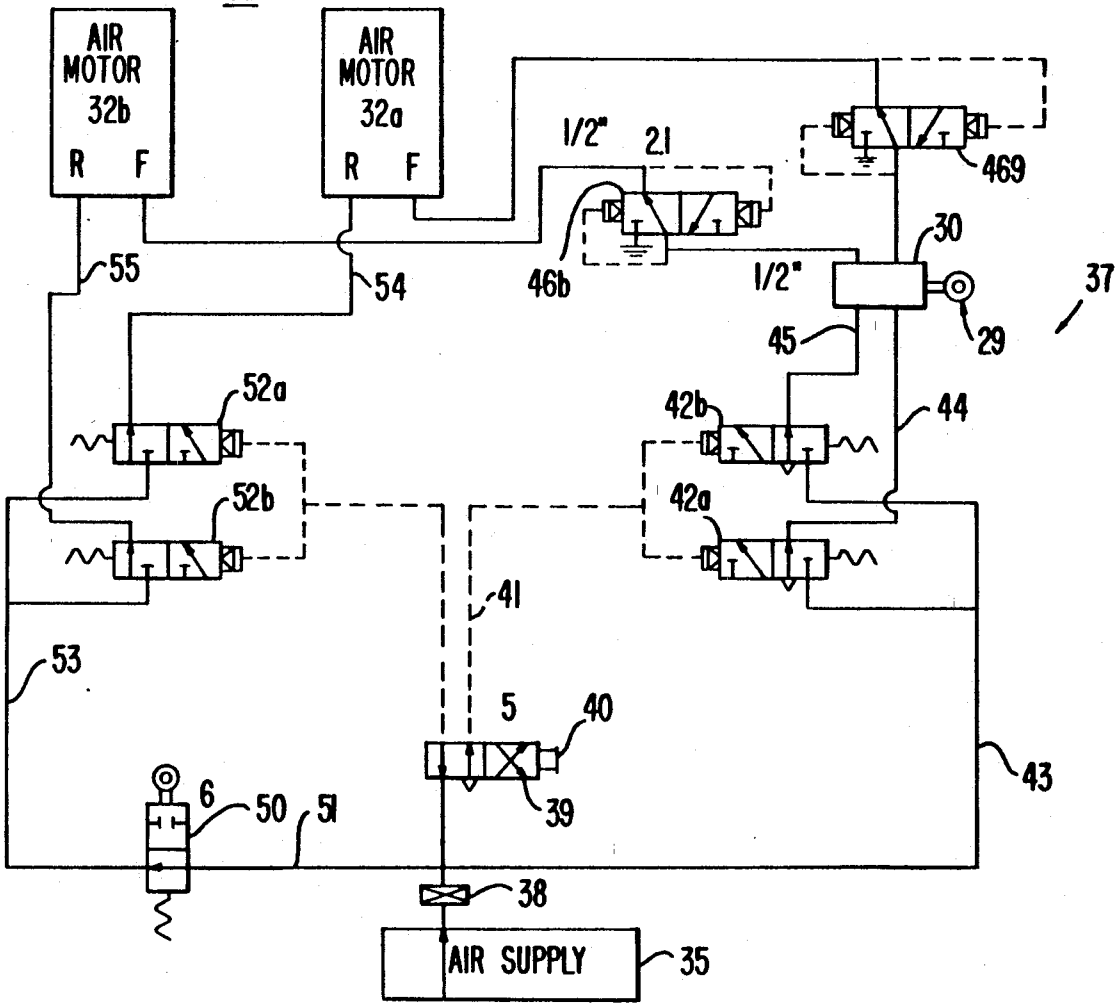
FIG. 3 is a pneumatic circuit according to the invention for controlling the deceleration of a moving bolster relative to a press.
Figure 6:
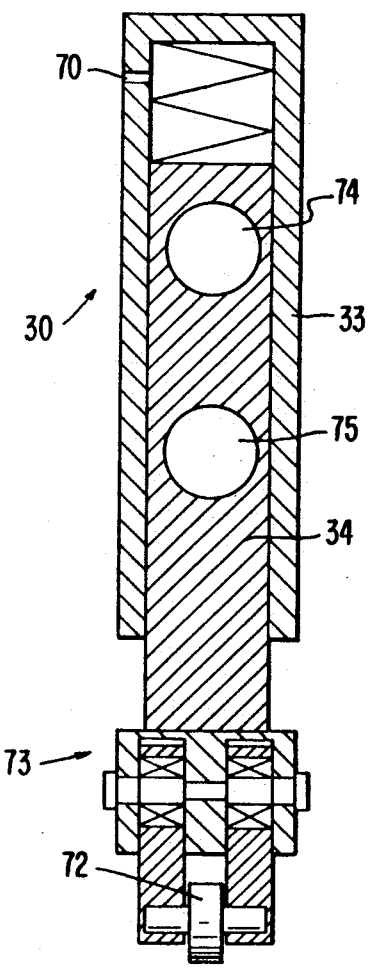
FIG. 6 is a cross-sectional view taken along line 6—6 of FIG. 4.
Figure 4:
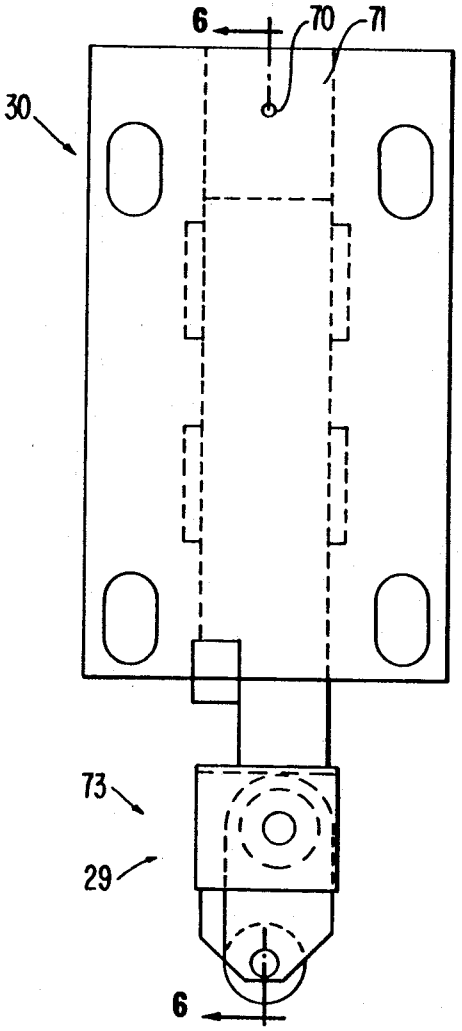
FIG. 4 is a side plan view of a deceleration valve preferably used in the circuit of FIG. 3 showing its cam-actuated operator for contacting the cam of FIG. 2.
Figure 5:
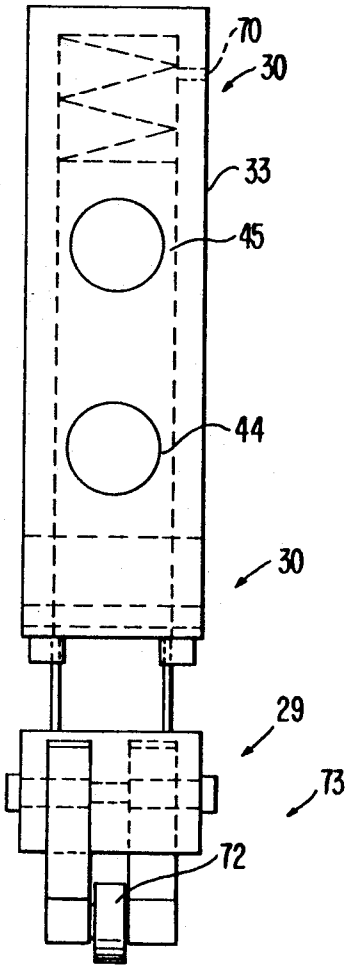
FIG. 5 is a frontal view of the deceleration valve of FIG. 4.

A deceleration valve 30, shown in detail in FIGS. 4 to 6, and referred to in the pneumatic circuit of FIG. 3, is mounted on the bolster 12, as seen in FIG. 2. The deceleration valve 30 is activated by contact between its cam roller 29 and a cam 90 shown in FIG. 7 mounted on the press bed adjacent to a rail 16. By the action of the deceleration valve 30, the main air lines running to an air motor 32 (seen in FIG. 3) are effectively rerouted through the deceleration valve 30 which in turn reduces the volume of air to the motor 32 when activated by the cam 90 causing the motor 32 to slow down. A feature of the deceleration valve 30, which will be discussed in greater detail, is that the valve has a limited clearance between the valve body 33 and the spool 34, such as about 0.010" ( thus allowing an internal bypass of air to the motor 32 after the valve 30 is closed by the cam 90. The by-pass air is used to idle the bolster 12 onto a stop 19 (FIG. 1) at a controlled rate of speed such as about 2 ft./min. The invention thus provides a significant improvement in the average speed of travel for a bolster 12 thus decreasing the time needed for a die change. Conventionally, the average speed of bolsters before modification according to the invention was about 10 to 15 ft./min., while the average speed after modification is about 30 to 45 ft./min.

Another significant feature of the invention as shown in the pneumatic circuit of FIG. 3 is that after the bolster 12 is on the stop 19, the main air supply 35 is shut off. A column of air is trapped between the motor 32 and the deceleration valve 30 which allows the bolster 12 to maintain a load on the stop 19 while the bolster 12 is lowered onto the press bed. The column of air is bled off to the atmosphere through a small air jet with a blow down time of about 20 seconds.

The pneumatic circuit for the invention is shown schematically in FIG. 3 and is designated generally by the reference numeral 37. Such a pneumatic circuit is, as is others in the field housed in the bolster 12 in a known manner. The circuit 37 includes an air supply source 35 such as a central air supply at the factory, connected by air hoses to the moving bolster 12. The air supply source 35 is connected through a manual or power actuated valve 38 to a 4-way, 2-position valve 39, having an actuator 40 for controlling a forward or a reverse direction for the air motor 32 and thus for the moving bolster 12. Assume first that the actuator 40 is positioned to control forward travel.

In that case, the air from the air supply 35 is channeled through the conduit 41 to a pair of directional valves 42*a* and 42*b* having a quick exhaust. When the valve 42*a* is open as determined by the presence of air from the line 41, air from the air supply 35 is provided through the conduit 43 through each of the valves 42*a* and 42*b* to the deceleration valve 30 through the conduits 44 and 45 respectively.

When the deceleration valve 30 is open, i.e. when the cam actuator 29 is not operative or in contact with the cam 90, air is supplied from the deceleration valve 30 to the forward port F of each of the air motors 32*a* and 32*b* through the quick exhaust valves 46*a* and 46*b* respectively.

Similarly, when the pilot-operated valve 39 is actuated to 10 be in its reverse direction controlling position, air is supplied through the conduit 51 to a pair of directional valves 52*a* and 52*b* having a quick exhaust.

When the valve 52*a* is open as determined by the presence of air from the valve 51, air from the air supply 35 is provided through the conduit 53 through each of the motors 32*a* and 32*b* to the deceleration valve 30 through the conduits 54 and 55 respectively.

A cam-operated valve 50 is positioned in the conduit 53 and is cam-actuated at the same time as the deceleration valve 30 to coordinate forward and reverse operations of the circuit. The circuit of FIG. 3 and its operation can be understood by those skilled in the art so further detailed discussion is not believed to be necessary.

In operation, the bolster 12 is thus caused to travel in a forward or a reverse direction according to the operation of the air motors 32*a* and 32*b*. Assuming that the forward direction is equivalent to withdrawal of the bolster 12 from the press 10, it can be noted that when the cam-actuator 29 for the deceleration valve 30 rides over the cam surface 91 of FIGS. 2 and 7 in the forward direction, the deceleration valve 30 is closed this stopping forward motion of the air motors 32*a*, 32*b*. At the same time, the valve 50 is also actuated, thus supplying air through the valve 50 to the valves 52*a* and 52*b*, thus reversing the drive on the air motor to stop the bolster 12 at a predetermined position. That predetermined position is at the stop 19; thus the position of the cam surface 91 of FIGS. 2 and 7 is located at a site which causes the bolster 12 to stop at the stop 19 given its momentum as determined by its mass and its velocity at the location of the stop, with the aid of the reversal of the motors 2*a*, 32*b*.

When the air to the motors 32*a*, 32*b* is in a reverse mode, as described, after actuation of the values 30, 50 by the cam 91, a release path for the air from the motors 32*a*, 46*b* is defined. The gap between the spool 34 and the value body thus controls the exit of air in the reverse mode to cause the motors to idle onto the stop 19. Once positioned, the air further blows down through the pilot hole 70. The spool 34 is biased open by a spring 71.

The cam roller 29 includes a wheel 72 rotatably secured to an assembly 73 at the lowermost end of the spool 34. When the wheel contacts the ramp 91, the spool 34 is forced upwardly, causing its through openings 74, 75 to deregister from the input ports 44*a*, 45*a* connected to the lines 44, 45.

Figure 7:
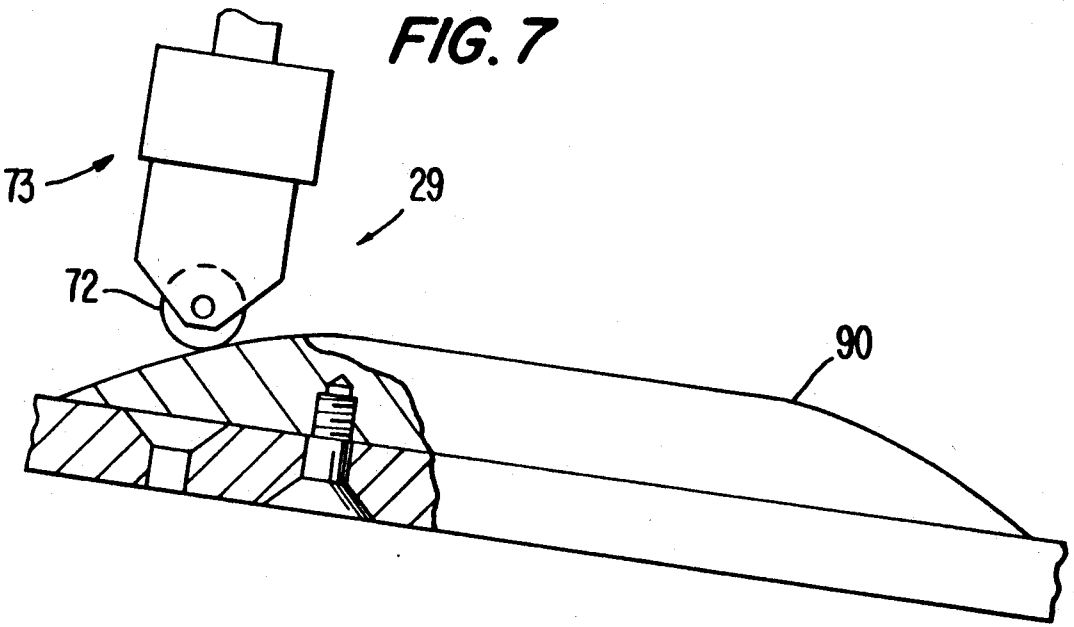
FIG. 7 is a side view of the cam mounted on the rails as shown in FIG. 2 for actuating the deceleration valve of FIGS. 4 to 6 in the circuit of FIG. 3.

FIG. 7 shows a side view of the cam surface 90 secured to the press bed as in FIGS. 1 and 2. As explained above, the cam surface 91 actuates the deceleration valve 30 and the valve 50 as shown and discussed in connection with FIGS. 3 to 6. As shown, the cam surface 91 is in the shape of a gentle curve so that when the cam-actuators 29 contact the cam surface 91, the movement of the spool 34 is smooth and free. The surface 91 could also be arranged to assume alternate shapes to provide desired and predetermined opening and closing characteristics for the deceleration valve when controlling the operation of the air motor.

While this invention has been described as having a preferred design, it will be understood that it is capable of further modification within the spirit of the invention. This application is, therefore, intended to cover any variations, uses, or adaptation of the invention following the general principles thereof and including such departures from the present disclose as come within know or customary practice in the art to which this invention pertains and fall within the limits of the appended claims.

What is claimed is:

1. A method of using a control circuit for moving a bolster used in connection with a press wherein the bolster traverses a predetermined path to and from a press to change dies mounted on the bolster, said method comprising the steps of:

providing pneumatic motor means for selectively actuating the moving bolster in a forward or a reverse direction along the predetermined path;

providing a source of supply for the motor means controlled by the circuit means, including providing supply control valves;

providing a deceleration valve in the circuit with the control valves for supplying motive power to the motor means in normal operation to drive the moving bolster;

operating the deceleration valve in response to a predetermined location along the predetermined path to cease motive power to the motor means, whereby the moving bolster decelerates to stop at a predetermined location at or near the end of the predetermined path; and providing a valve means for cooperating with the motor means for causing the motor means to operate in a reverse direction, wherein the valve means is provided with a pilot valve responsive to the predetermined location along the predetermined path to control the reverse operation of the motor means.

2. The method of claim 1 comprising steps of providing a cam at the predetermined location so that the deceleration valve is actuated by contact with the cam.

3. The method of claim 2 wherein the pilot valve is also actuated by the cam.

4. The method of as set forth in claim 2 wherein the step of providing a deceleration valve includes providing a valve body and a spool mounted in valve body with a predetermined clearance between the spool and the valve body to permit a leakage of air to bleed off air between the valve means and the motor means when the deceleration valve is actuated.

* * * * *